United States Patent [19]

Schutz

[11] 4,431,141

[45] Feb. 14, 1984

[54] METHOD OF MAKING A ROLL PAPER PRODUCT

[75] Inventor: Rudolph W. Schutz, Walnut Creek, Calif.

[73] Assignee: Crown Zellerbach Corporation, San Francisco, Calif.

[21] Appl. No.: 387,293

[22] Filed: Jun. 10, 1982

[51] Int. Cl.[3] ..... B65H 35/02; B65H 17/02

[52] U.S. Cl. ..... 242/56.2; 242/67.1 R

[58] Field of Search ..... 242/56.2, 57.1, 67.1 R, 242/68, 1, 56.6, 56.7

[56] References Cited

U.S. PATENT DOCUMENTS

| | | | |
|---|---|---|---|
| 3,038,598 | 6/1962 | Layton et al. | 242/1 |
| 3,089,659 | 5/1963 | Perrin | 242/55.2 |
| 3,282,525 | 11/1966 | Rehr | 242/56.2 |
| 3,642,222 | 2/1972 | Leysinger | 242/57.1 X |
| 4,160,531 | 7/1979 | Van Gompel | 242/67.1 R X |
| 4,201,352 | 5/1980 | Madachy | 242/56.2 |

*Primary Examiner*—John M. Jillions
*Assistant Examiner*—Scott J. Haugland
*Attorney, Agent, or Firm*—Thomas R. Lampe

[57] ABSTRACT

Method for making a roll paper product formed from a web having a substantially uniform width and having a groove end and a boss end formed by the convolutions of the web.

4 Claims, 3 Drawing Figures

METHOD OF MAKING A ROLL PAPER PRODUCT

BACKGROUND OF INVENTION

1. Field of Invention

This invention relates to a method of making an automatically dismountable roll paper product formed from an elongated sheet of paper wound about a core. During winding, the core and paper are relatively displaced axially to provide a groove at one end of the roll product and a boss at the other.

2. Description of the Prior Art

U.S. Pat. No. 3,038,598 issued June 12, 1962 to Layton et al., relates to an automatically dismountable roll of strip material which has a bearing wall adapted to be supported upon an appropriate supporting member in a dispenser cabinet and to be automatically dismounted therefrom when it has been consumed to a predetermined extent. U.S. Pat. No. 3,089,659 issued May 14, 1963 to J. L. Perrin discloses the method of automatically dismounting the roll product of U.S. Pat. No. 3,038,598. The bearing wall is formed by the convolutions of the roll product which are relatively disposed to form a recess or detent in the end of the roll. U.S. Pat. No. 3,282,525 issued Nov. 1, 1966 to H. W. Rehr illustrates an apparatus and method which have been utilized to form the recess and bearing surface. According to this latter patent laterally movable score slitting knives are employed in combination with a platen roll to cut a parent web into a plurality of web strips which are wound on a revolving winder that is fixed in the cross machine direction. The apparatus of the aforesaid Rehr patent is restricted to the use of score slitting knives which limits its applicability to certain types of web materials and results in a relatively high knife blade wear rate. Further, the requirement for synchronized knife motion requires a rather complex and expensive knife support and transport mechanism.

Another method that has been employed to form the recess is to actually bore the recess at the end of the roll after it is formed by means of a rotating cutting tool. This approach has the drawback of producing waste. In addition, if the cutting tool is not maintained in a sharp condition or the roll is soft or embossed the portion of the roll product forming the recess may become rough and ragged and not aesthetically pleasing to the end user.

BRIEF SUMMARY OF THE INVENTION

According to the teachings of the present invention a roll product having a supporting recess and bearing wall is produced from a sheet of paper material of substantially uniform width. The method for producing the roll is adapted to use any desired slitter knife type. Further, since it does not utilize laterally mobile knives there is no requirement for an expensive and complex arrangement for accomplishing such movements. In addition, material wastage is minimized and there is no need to employ a rotating cutting tool to form the recess and bearing wall. The present roll paper product has a groove end formed by convolutions axially displaced along the core about which the paper is wound during the winding process. The axially displaced convolutions additionally form at the other end of the roll product a boss in registry with the groove, said boss including a bearing wall leading to a recess. The configuration of the boss corresponds exactly to that of the groove whereby a plurality of roll products may be readily stacked on end in a stable manner. The end of the roll forming the groove also has two spaced lands which cooperate to provide stability to the roll, resist telescoping thereof and improve the handling characteristics of the product. According to the present arrangement the cutter knives remain in fixed position relative to the parent web in the cross machine direction. After the parent web is cut it is directed to a winder and wound on cores. The cores are laterally displaced relative to the web to form a plurality of roll products of the above-described type. The method is applicable to paper sheets having a wide range of physical properties. The recess may be formed for example on soft or embossed sheets wound less tightly than is presently necessary, for example, when a rotary cutter tool is applied to the roll after formation thereof.

DETAILED DESCRIPTION

Figure 1:
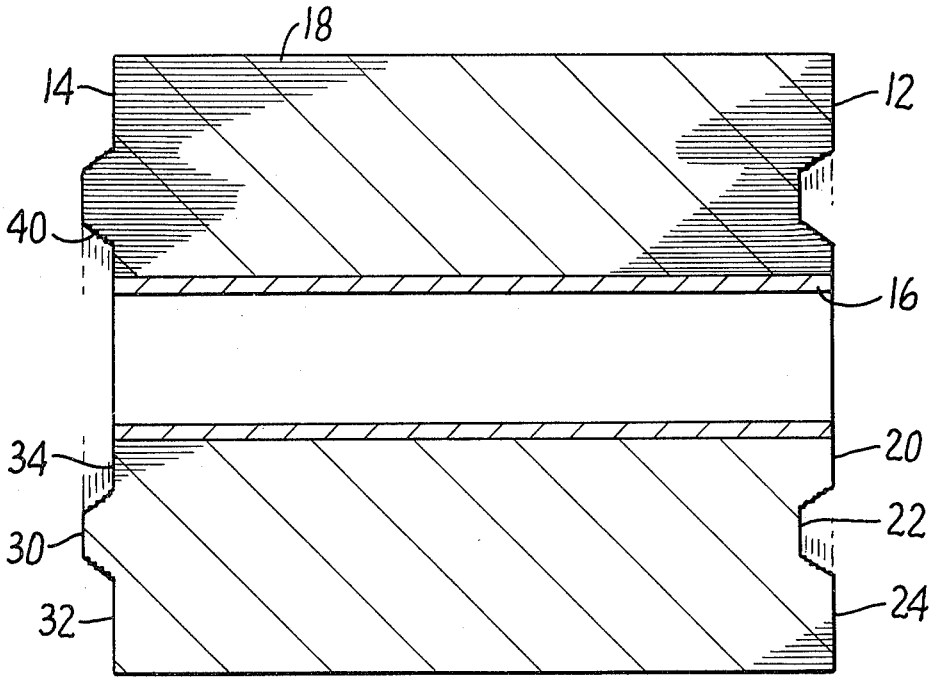
FIG. 1 is a cross sectional view of a preferred embodiment of the roll product constructed according to the teachings of the present invention.

FIG. 1 illustrates a roll product produced by the method of the present invention. The roll paper product has a groove end 12 and a boss end 14. The product comprises a cylindrically shaped core 16 about which an elongated sheet of paper 18 has been wound thereabout to provide a plurality of overlapping convolutions. The elongated sheet of paper is of substantially uniform width along the length thereof and the convolutions of the paper are displaced axially relative to the cylindrically shaped core to provide at the groove end a first land surface 20 adjoining and substantially coextensive with a first end of the core, a groove 22 axially displaced inwardly from the core end, and a second land surface 24 spaced from the first land surface and substantially coextensive with the first core end.

Since the paper web forming the convolutions is of substantially uniform width the boss end 14 of the product has a boss 30 projecting outwardly from the second end of the core and from spaced recess surfaces 32 and 34 which are in registry with lands 24 and 20, respectively. Boss 30 includes a bearing wall 40 extending to recess surface 34 which is substantially coextensive with the end of the core. Bearing wall 40 is adapted to provide a support surface for the boss end of the roll when the support surface is mounted in a dispensing cabinet, such as that shown for example, in the aforesaid U.S. Pat. No. 3,089,659. When all or most of the convolutions of the paper web forming the boss 40 are used up the roll will drop from its associated support in the manner shown in the aforesaid patent.

Figure 2:
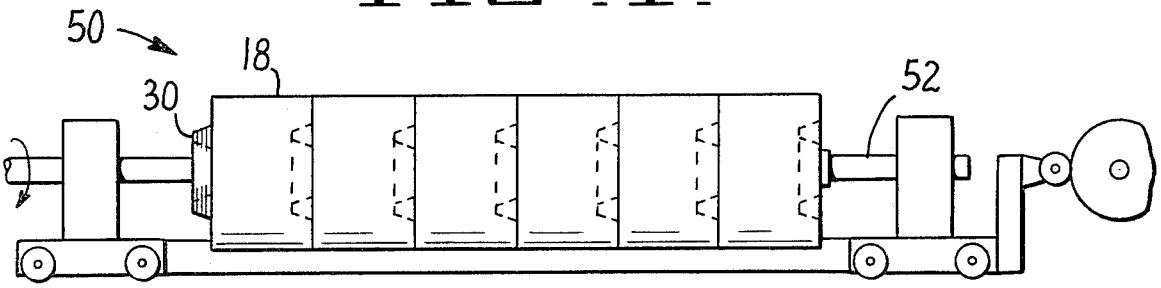
FIGS. 2 and 3 are schematic end and plan views, respectively, illustrating an arrangement for carrying out the method of the present invention.
Figure 3:
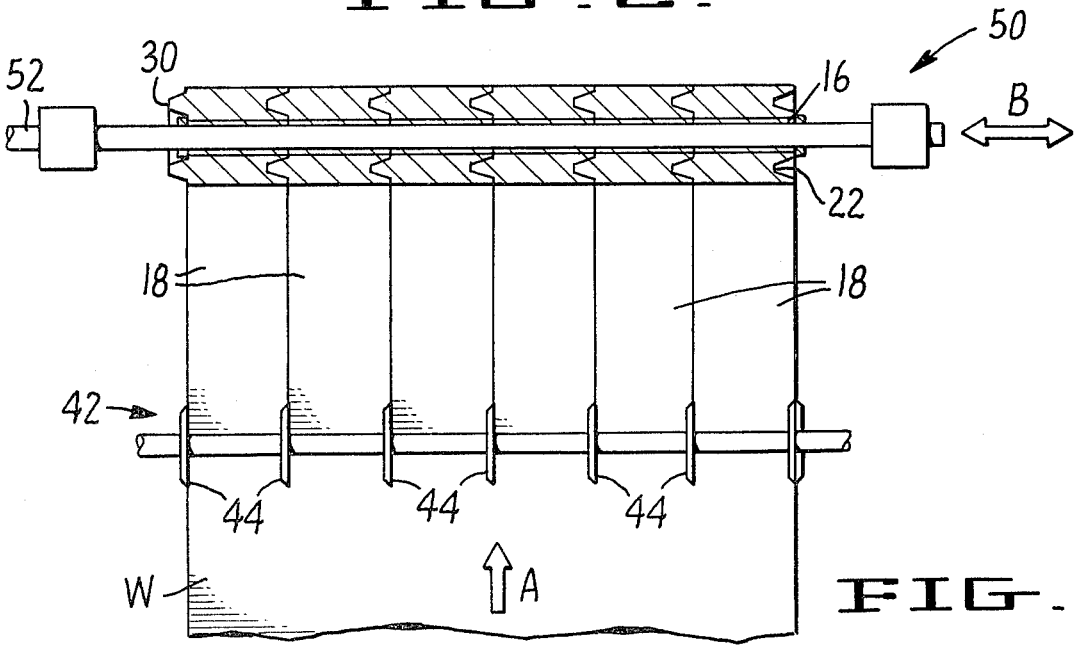

FIGS. 2 and 3 illustrate a preferred approach for making the roll product of FIG. 1. A parent paper web W is transported in the direction of arrow A past a first station 42 whereat a plurality of rotating cutter blades 44 slit the parent web W into a plurality of individual paper webs 18 with the cutters 44 along the edges of the parent roll W trimming off any excess that may be at the edges thereof. Paper webs 18 are transported to a winder station 50 whereat the web segments 18 are wound about aligned cores 16 disposed about a rotating winder shaft 52 in a well known manner. As previously stated, the configuration of the paper web on each core is provided by relative axial displacement between the elongated paper web and the core. As winder shaft 52 is rotated and the paper webs are wound about the respective cores 16 the shaft 52 at winder station 50 is moved back and forth in the path indicated by the two headed arrow B shown in FIG. 3. That is, the shaft 52 and cores 16 are moved laterally relative to the path of movement of webs 18 between first station 22 and the winder station 50 and parallel to the longitudinal axis of the core. Each core is first maintained in alignment with its respective paper web 18 and a sufficient number of convolutions are wound about the core to form first land surface 20 and recess surface 34 in alignment therewith. The core is then laterally shifted relative to its assorted paper web 18 to form groove 22 and boss 30. The core is then laterally shifted in a reverse direction to form second land surface 24 and recess surface 32 in alignment therewith. Winding of the web about the core continues until the desired diameter is reached and winding has been terminated.

Rather than laterally moving the rolls to provide the desired relative displacement, the rolls could be wound at a fixed station and the webs laterally moved relative thereto after passing the fixed knives by any desired suitable mechanism such as movable web support rollers. Whether the lateral displacement is provided at the winding station or by shifting the webs themselves any suitable shifting mechanism may be employed for such purpose. FIG. 3, for example, illustrates schematically the use of a cam surface to effect laterally shifting of the winder shaft. Naturally, the shape of the cam will be dictated by the precise shape of the groove and boss ends of the finished product.

I claim:

1. A method of making a plurality of roll paper products having a circular groove at one end and an aligned circular boss at the other end, said roll paper products being disposed end to end with the grooves of said roll paper products accommodating in nesting fashion the bosses of adjacent roll paper products, comprising the steps of:

transporting a parent paper web past a plurality of knives fixed in a cross machine direction relative to the parent web to cut the parent web into a plurality of elongated paper webs of substantially uniform width;

transporting each elongated paper web having a substantially uniform width from a first location to a second location along a predetermined path of movement;

at said second location, disposing a plurality of cores of predetermined length about a support shaft whereby said cores are aligned end to end in a direction generally perpendicular to said path of movement;

at said second location winding each said elongated paper web around a core by applying rotational forces to said support shaft to rotate said support shaft and said aligned cores;

moving said support shaft and said aligned cores endwise in a first direction to provide relative axial displacement between each said elongated paper web and the core about which it is being wound laterally relative to said predetermined path of movement and laterally relative to said fixed knives as the elongated paper web is wound about the core to simultaneously form said groove and boss with the displaced elongated paper web convolutions;

subsequently moving said support shaft and said aligned cores endwise in a reverse direction to provide relative axial displacement between each said elongated paper web and the core about which it is being wound after formation of said groove and boss;

terminating relative axial displacement between each said elongated paper web and the core about which it is being wound by halting endwise movement of said support shaft and said aligned cores;

continuing winding of each said elongated paper web about the core about which it is being wound by applying rotational forces to said support shaft to rotate said support shaft and said aligned cores; and terminating winding of each said elongated paper web on the core about which it is wound by ceasing the application of rotational forces to said support shaft.

2. The method of claim 1 wherein said step of continuing winding of each said elongated paper web on the core about which it is wound after relative axial displacement in said reverse direction forms a second land surface aligned with said first land surface and spaced therefrom by said groove.

3. The method of claim 1 additionally comprising with respect to each elongated paper web the step of winding a plurality of convolutions of said elongated paper web on its said core before relative axial displacement between said elongated paper web and core to form a first land surface at one end of said roll and adjoining said core.

4. The method of claim 3 wherein said first land surface is maintained in alignment with a core end.

* * * * *